US011678698B2

(12) United States Patent
Liu

(10) Patent No.: US 11,678,698 B2
(45) Date of Patent: Jun. 20, 2023

(54) HANDHELD HOOKAH

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 274 days.

(21) Appl. No.: 17/096,927

(22) Filed: Nov. 12, 2020

(65) Prior Publication Data

US 2021/0274835 A1 Sep. 9, 2021

(30) Foreign Application Priority Data

Mar. 9, 2020 (CN) ..... 202010159626.2
Mar. 9, 2020 (CN) ..... 202020281382.0

(51) Int. Cl.
*A24F 1/30* (2006.01)
*A24F 40/485* (2020.01)
*A24F 40/465* (2020.01)

(52) U.S. Cl.
CPC ..... *A24F 1/30* (2013.01); *A24F 40/465* (2020.01); *A24F 40/485* (2020.01)

(58) Field of Classification Search
CPC ..... A24F 40/485; A24F 40/465; A24F 1/30
See application file for complete search history.

(56) References Cited

U.S. PATENT DOCUMENTS 10,321,714 B1 * 6/2019 Kane ..... A24F 40/50

* cited by examiner

*Primary Examiner* — Michael H. Wilson
*Assistant Examiner* — Miles A Simpson
(74) *Attorney, Agent, or Firm* — Matthias Scholl P.C.; Matthias Scholl

(57) ABSTRACT

A handheld hookah includes a gas valve assembly including a gas valve and a central shaft. The gas valve includes a first air duct and a second air duct. The central shaft includes a third air duct and a fourth air duct. The first air duct and the second air duct each includes a first end and a second end. When in use, the handheld hookah is placed vertically and added with water, a liquid level of the water is lower than that of the first end of the second air duct, but higher than that of the second end of the first air duct. The first end of the first air duct is connected to the third air duct so that the smoke goes into the first air duct from the third air duct. The second end of the first air duct is disposed in the water.

11 Claims, 3 Drawing Sheets

HANDHELD HOOKAH

CROSS-REFERENCE TO RELATED APPLICATIONS

Pursuant to 35 U.S.C.§ 119 and the Paris Convention Treaty, this application claims foreign priority to Chinese Patent Application No. 202010159626.2 filed Mar. 9, 2020, and to Chinese Patent Application No. 202020281382.0 filed Mar. 9, 2020; the contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to a handheld hookah.

A conventional hookah is ignited by open fire, and the smoke volume produced by the hookah is unregulatable.

SUMMARY

A handheld hookah comprises a gas valve assembly comprising a gas valve and a central shaft. The gas valve comprises a first air duct and a second air duct. The central shaft comprises a third air duct and a fourth air duct. The first air duct and the second air duct each comprises a first end and a second end. When in use, the handheld hookah is placed vertically and added with water, a liquid level of the water is lower than that of the first end of the second air duct, but higher than that of the second end of the first air duct. The first end of the first air duct is connected to the third air duct so that the smoke goes into the first air duct from the third air duct. The second end of the first air duct is disposed in the water so that the smoke is filtered through the water. The first end of the second air duct is disposed above the liquid level of the water so that the filtered smoke can enter the second air duct. The second end of the second air duct is connected to the fourth air duct through which the smoke is discharged to a cigarette holder for user's inhaling.

In a class of this embodiment, the gas valve is disposed on the central shaft and is rotatable around the central line of the central shaft. The gas valve comprises a first side and a second side, and the first side is heavier than the second side. The first air duct communicates with the first side, and the second air duct communicates with the second side. The third air duct and the fourth air duct of the central shaft are separated from each other.

In a class of this embodiment, the gas valve is connected to the central shaft via a bearing assembly. The bearing assembly is rotatable around the central axial of the central shaft to drive the gas valve to rotate.

In a class of this embodiment, the bearing assembly comprises a first bearing, a first sleeve, and a second bearing. The first bearing and the second bearing are respectively disposed on the central shaft. The first sleeve is configured to receive the first bearing and the second bearing. The valve is disposed on the first sleeve.

In a class of this embodiment, the gas valve assembly further comprises a circlip, an upper seal ring and a low seal ring. The circlip is disposed on the top of the first sleeve. The upper seal ring and the low seal ring are respectively disposed on both ends of the central shaft so as to prevent air leakage from the central shaft.

In a class of this embodiment, the handheld hookah further comprises a cylindrical glass tube.

In a class of this embodiment, the handheld hookah further comprises an electromagnetic induction heater. The electromagnetic induction heater comprises a conductive container and a plurality of electromagnetic coils. The plurality of electromagnetic coils is disposed coaxially around the conductive container so that when the plurality of electromagnetic coils is electrified, the conductive container produces heat through electromagnetic induction to heat the smoking material.

In a class of this embodiment, the electromagnetic induction heater further comprises a third sleeve, a cover, and a ceramic cup. The cover is disposed on the conductive container. The conductive container with the cover is disposed in the ceramic cup, and the third sleeve is configured to receive the plurality of electromagnetic coil, so as to prevent short circuit due to a direct contact of the conductive container and the plurality of electromagnetic coil.

In a class of this embodiment, the electromagnetic induction heater further comprises a temperature sensor disposed in the bottom of the ceramic cup. The temperature sensor is configured to transmit a request for a decrease of an output power when a preset temperature is detected in the conductive container.

In a class of this embodiment, the electromagnetic induction heater further comprises a set screw, a control board, and a battery cell. The output terminal of the battery cell is connected to the input terminal of the control board. The output terminal of the control board is secured to the input terminal of the plurality of electromagnetic coils via the set screw so as to supply electric power to the plurality of electromagnetic coil.

In a class of this embodiment, the handheld hookah further comprises a gas regulating assembly. The gas regulating assembly comprises a third seal ring and a fixed base. The third seal ring comprises a first hole, and the fixed base comprises a second hole. The third seal ring is rotated until the first hole is aligned with the second hole to regulate a volume of airflow.

In a class of this embodiment, the gas regulating assembly further comprises a fourth sleeve and a second seal ring. The third seal ring is disposed outside the fourth sleeve. The second seal ring is disposed between the fourth sleeve and the third seal ring to prevent air leakage. The fixed base is disposed in the fourth sleeve.

The hookah comprises an electromagnetic assembly, in which the conductor wound with a plurality of electromagnetic coils is configured to heat the smoking materials. The hookah comprises a gas valve. When the hookah is disposed horizontally and added with water, the first end of the second air duct, and the second end of the first air duct are upward above the water surface, ensuring normal smoke discharge. The hookah comprises a gas regulating device that regulates the smoke flow by rotating a third seal ring.

DETAILED DESCRIPTION

To further illustrate the disclosure, embodiments detailing a hookah are described below. It should be noted that the following embodiments are intended to describe and not to limit the disclosure.

Figure 1:
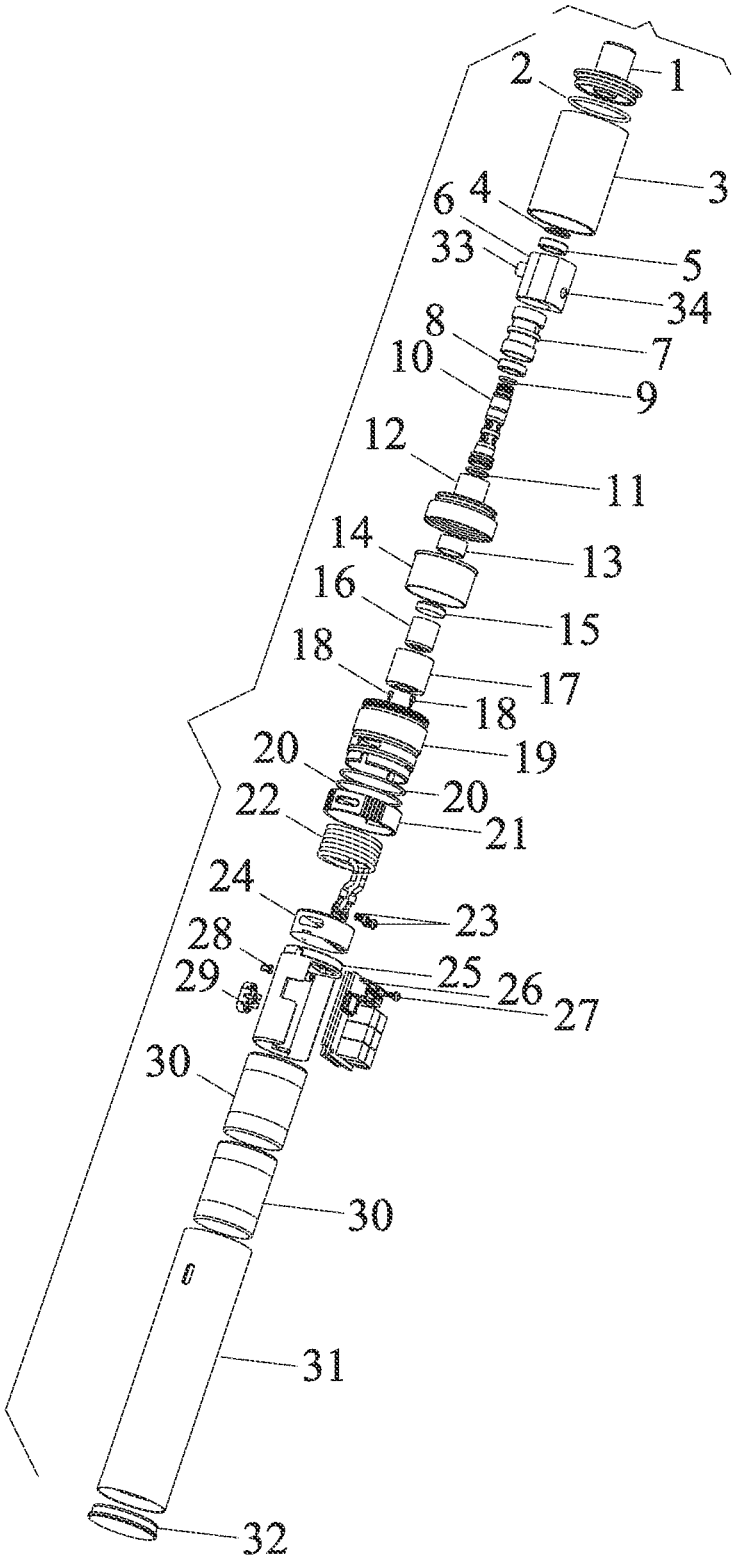
FIG. 1 is an exploded view of a hookah in accordance with one embodiment of the disclosure.
Figure 2:
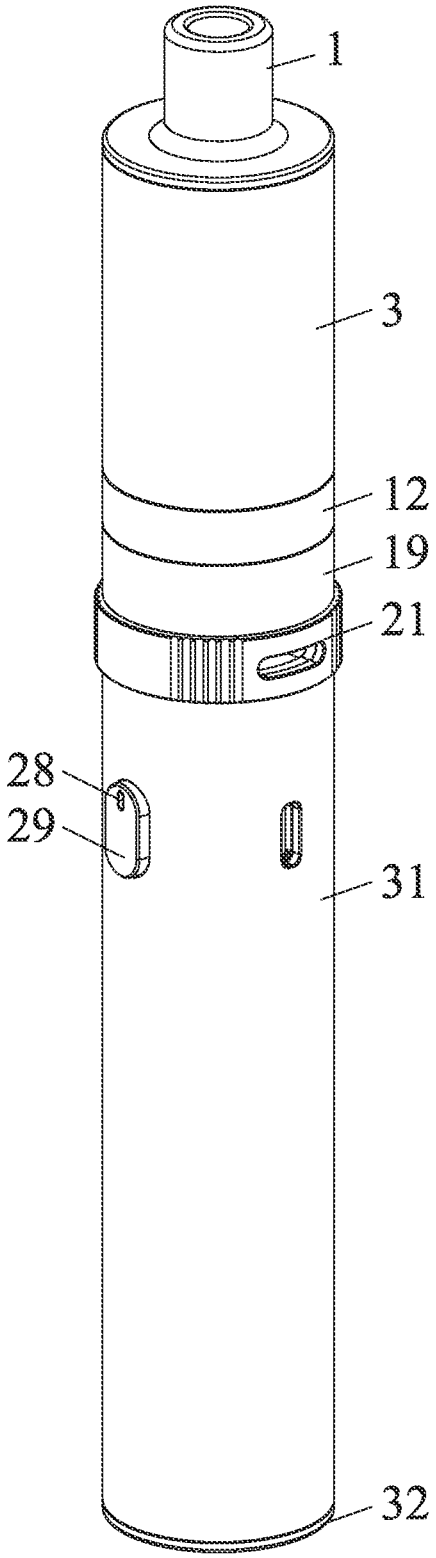
FIG. 2 is a schematic diagram of a hookah in accordance with one embodiment of the disclosure.
Figure 3:
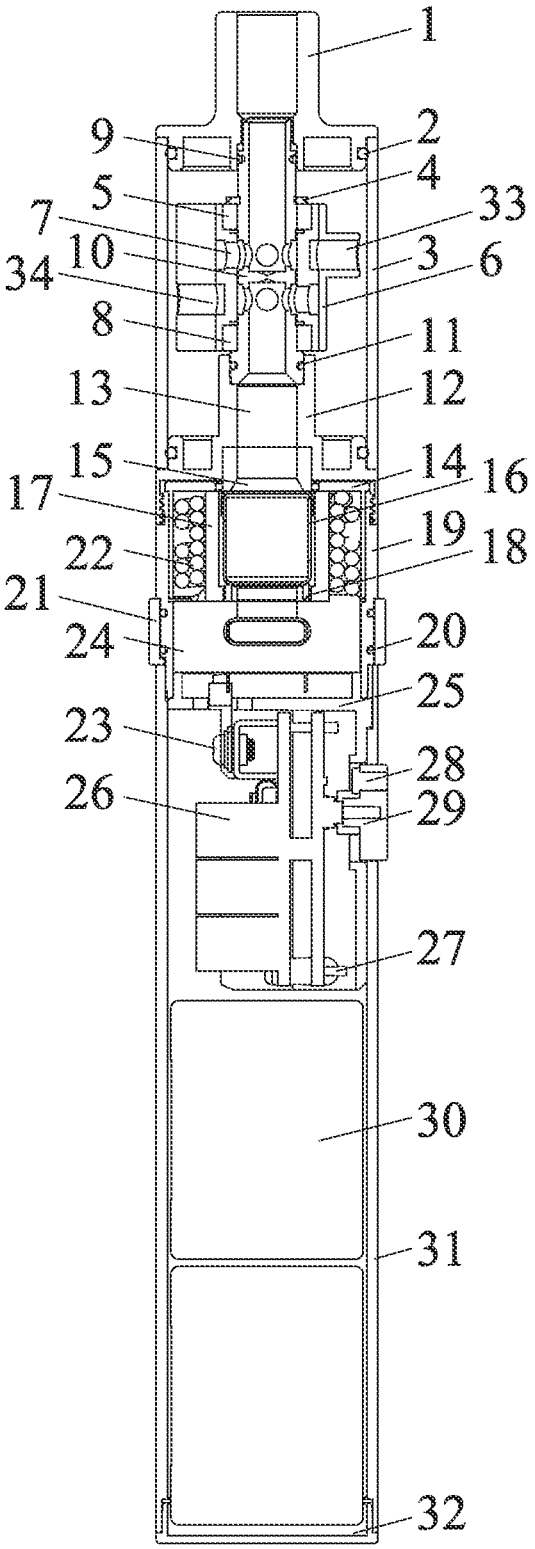
FIG. 3 is a sectional view of a hookah in accordance with one embodiment of the disclosure.

As shown in FIGS. 1-3, the disclosure provides a hookah comprising a cigarette holder 1, a first seal ring 2, a glass tube 3, a circlip 4, a first bearing 5, a gas valve 6, a first sleeve 7, a second bearing 8, a upper seal ring 9, a central shaft 10, a low seal ring 11, a base 12, a second sleeve 13, a third sleeve 14, a cover 15, a conductive container 16, a ceramic cup 17, a temperature sensor 18, a fourth sleeve 19, a second seal ring 20, a third seal ring 21 comprising a first hole, a plurality of electromagnetic coils 22, a set screw 23, a fixed base 24 comprising a second hole and a five air duct, a support bracket 25, a control board 26, a second screw 27, a lamp post 28, a button 29, a battery cell 30, a battery pack 31, and a battery cover 32. The first seal ring 2 is disposed on the cigarette holder 1, and the cigarette holder 1 is disposed on the glass tube 3, creating a seal between the cigarette holder 1 and the glass tube 3. The gas valve 6 comprises a first air duct 34 and a second air duct 33. The central shaft 10 comprises a third air duct and a fourth duct. The first end of the first air duct 34 is connected to the third air duct, and the second end of the first air duct is disposed in the water. The first end of the second air duct 33 is disposed over the liquid level of the water, and the second end of the second air duct 33 is connected to the fourth duct. When the gas valve 6 is placed vertically and introduced with water, the liquid level of the water is lower than that of the first end of the second air duct 33, but higher than that of the second end of the first air duct 34.

The upper seal ring 9 and the low seal ring 11 are respectively disposed on both ends of the central shaft 10. The first bearing 5 and the second bearing 8 are respectively disposed on the central shaft 10 and is rotatable around the central axis of the central shaft 10. The first sleeve 7 is disposed on the central shaft 10 and configured to receive the first bearing 5 and the second bearing 8. The gas valve 6 is disposed outside the first sleeve 7 so as to rotate with the first bearing 5 and the second bearing 8 on the ventral shaft 10. The central shaft 10 is inserted through the bottom of the glass tube 3, exists through the top of the glass tube 3, and then is threaded and screwed into a thread cut in the cigarette holder 1. The second sleeve 13 is disposed in the bottom of the base 12 so as to secure the central shaft 10 to the base 12. The base 12 is disposed at the bottom of the glass tube 3 and the central shaft 10 is pushed into the second sleeve 13. The output terminal of the control board 26 is secured to the input terminal of the plurality of electromagnetic coils 22 with a set screw 23 so as to supply electric power to the plurality of electromagnetic coils 22. The cover 15 is disposed on the conductive container 16 so as to prevent the smoking materials going into the ceramic cup 17. As used herein, the term "smoking materials" refer to the materials that give out smoke on burning, such as e-liquid, hookah paste, and tobacco. The conductive container 16 with the cover 15 is disposed in the ceramic cup 17 so as to prevent short circuit due to a direct contact of the conductive container 16 and the plurality of electromagnetic coils 22. The plurality of electromagnetic coils ceramic cup 17 is disposed coaxially around the ceramic cup 17. The temperature sensor 18 is disposed in the bottom of the ceramic cup 17, and transmits a request for a decrease of an output power to the control board 26 when the highest temperature is detected in the conductive container 26. The third sleeve 14 is configured to receive the plurality of electromagnetic coils 22 so as to protect the plurality of electromagnetic coils 22 against contact with other components. The third sleeve 14 is disposed in the fourth sleeve 19. The second seal ring 20 is disposed between the fourth sleeve 19 and the third seal ring 21 so as to create a seal at the interface. The third seal ring 21 is disposed outside the fourth sleeve 19 so as to regulate the flow of the smoke. The fixed base 24 is disposed in the fourth sleeve 19 so that the smoke flows from first hole of the third seal ring 21, through the fifth air duct to the third air duct. The base 12 is threaded and screwed into a thread cut in the fourth sleeve 19. The control board 26 is secured to the support bracket 25 with a screw. The fourth sleeve 19 is configured to receive the support bracket 25. The lamp post 28 is disposed on the button 29. The button is disposed on the control board 26. The battery cell 30 and the support bracket 25 are disposed in the battery pack 31. The fourth sleeve 19 receives the top of the battery pack 31, and the battery cover 32 is pressed into the bottom of the battery pack 31.

In one embodiment of the disclosure, the gas valve is secured to the base 12. The gas valve 6 comprises a first air duct and a second air duct, which are disposed on the same side of the gas valve. The glass tube has an irregular shape, for example, a cylindrical tube lacking a section of arc. The first air duct and the second air duct are respectively perpendicular to the straight-line curved surface of the glass tube. When the hookah is placed horizontally and added with water, the first end of the second air duct, and the second end of the first air duct are respectively higher than the water surface. In another embodiment of the disclosure, the gas valve 6 is secured to the base 12, and the glass tube 3 has a cylindrical shape. The hookah further comprises a support base providing a safe place to support the hookah.

1. The hookah comprises an electromagnetic assembly, in which the conductor wound with a plurality of electromagnetic coils is configured to heat the smoking materials.

2. The hookah comprises a gas valve. When the hookah is disposed horizontally and added with water, the first end of the second air duct, and the second end of the first air duct are upward above the water surface, ensuring normal smoke discharge.

3. The hookah comprises a gas regulating device that regulates the smoke flow by rotating a third seal ring.

It will be obvious to those skilled in the art that changes and modifications may be made, and therefore, the aim in the appended claims is to cover all such changes and modifications.

The invention claimed is:

1. A hookah, comprising a gas valve assembly comprising a gas valve and a central shaft;

wherein:

the gas valve comprises a first air duct and a second air duct the central shaft comprises a third air duct and a fourth air duct the first air duct and the second air duct each comprises a first end and a second end;

when in use, the hookah is placed vertically and added with water, a liquid level of the water is lower than that of the first end of the second air duct, and higher than that of the second end of the first air duct;

the first end of the first air duct is connected to the third air duct so that smoke goes into the first air duct from the third air duct;

the second end of the first air duct is disposed in the water so that the smoke is filtered through the water;

the first end of the second air duct is disposed above the liquid level of the water so that the filtered smoke enters the second air duct;

the second end of the second air duct is connected to the fourth air duct through which the smoke is discharged to a cigarette holder for user's inhaling;

the gas valve is disposed on the central shaft and is rotatable around a central line of the central shaft the gas valve comprises a first side and a second side, and the first side is heavier than the second side; the first air duct communicates with the first side, and the second air duct communicates with the second side; the third air duct and the fourth air duct of the central shaft are separated from each other; and the gas valve is connected to the central shaft via a bearing assembly; the bearing assembly is rotatable around the central axial of the central shaft to drive the gas valve to rotate.

2. The hookah of claim 1, wherein the bearing assembly comprises a first bearing, a first sleeve, and a second bearing; the first bearing and the second bearing are respectively disposed on the central shaft; the first sleeve is configured to receive the first bearing and the second bearing; the valve is disposed on the first sleeve.

3. The hookah of claim 2, wherein the gas valve assembly further comprises a circlip, an upper seal ring and a low seal ring; the circlip is disposed on a top of the first sleeve; the upper seal ring and the low seal ring are respectively disposed on both ends of the central shaft so as to prevent gas leakage from the central shaft.

4. The hookah of claim 3, wherein the hookah further comprises a cylindrical glass tube.

5. The hookah of claim 3, wherein the hookah further comprises an electromagnetic induction heater; the electromagnetic induction heater comprises a conductive container and a plurality of electromagnetic coils; the plurality of electromagnetic coils is disposed coaxially around the conductive container so that when the plurality of electromagnetic coils is electrified, the conductive container produces heat through electromagnetic induction to heat a smoking material placed in the conductive container.

6. The hookah of claim 5, wherein the hookah further comprises a gas regulating assembly; the gas regulating assembly comprises a third seal ring and a fixed base; the third seal ring comprises a first hole, and the fixed base comprises a second hole; the third seal ring is configured to rotate such that the first hole can be aligned with the second hole for regulating a volume of airflow.

7. The hookah of claim 5, wherein the electromagnetic induction heater further comprises a third sleeve, a cover, and a ceramic cup; the cover is disposed on the conductive container; the conductive container with the cover is disposed in the ceramic cup, and the third sleeve is configured to receive the plurality of electromagnetic coil, so as to prevent short circuit due to a direct contact of the conductive container and the plurality of electromagnetic coil.

8. The hookah of claim 7, wherein the electromagnetic induction heater further comprises a temperature sensor disposed in a bottom of the ceramic cup; the temperature sensor is configured to transmit a request for a decrease of an output power when a preset temperature is detected in the conductive container.

9. The hookah of claim 8, wherein the electromagnetic induction heater further comprises a set screw, a control board, and a battery cell; an output terminal of the battery cell is connected to an input terminal of the control board; an output terminal of the control board is secured to an input terminal of the plurality of electromagnetic coils via a set screw so as to supply electric power to the plurality of electromagnetic coil.

10. The hookah of claim 3, wherein the hookah further comprises a gas regulating assembly; the gas regulating assembly comprises a third seal ring and a fixed base; the third seal ring comprises a first hole, and the fixed base comprises a second hole; the third seal ring is rotated until the first hole is aligned with the second hole to regulate a volume of airflow.

11. The hookah of claim 10, wherein the gas regulating assembly further comprises a fourth sleeve and a second seal ring; the third seal ring is disposed outside the fourth sleeve; the second seal ring is disposed between the fourth sleeve and the third seal ring to prevent air leakage; the fixed base is disposed in the fourth sleeve.

* * * * *